US012324456B2

(12) United States Patent
Volgger et al.

(10) Patent No.: US 12,324,456 B2
(45) Date of Patent: Jun. 10, 2025

(54) HYDRO-ENTANGLED FILTER MATERIAL FOR SMOKING PRODUCTS

(71) Applicant: DELFORTGROUP AG, Traun (AT)

(72) Inventors: Dietmar Volgger, Gnadenwald (AT); Stefan Bachmann, Fulpmes (AT)

(73) Assignee: DELFORTGROUP AG, Traun (AT)

( * ) Notice: Subject to any disclaimer, the term of this patent is extended or adjusted under 35 U.S.C. 154(b) by 413 days.

(21) Appl. No.: 17/782,506

(22) PCT Filed: Dec. 13, 2019

(86) PCT No.: PCT/EP2019/085125
§ 371 (c)(1),
(2) Date: Jun. 3, 2022

(87) PCT Pub. No.: WO2021/115619
PCT Pub. Date: Jun. 17, 2021

(65) Prior Publication Data

US 2023/0016316 A1 Jan. 19, 2023

(51) Int. Cl.

| | |
|---|---|
| ***A24D 3/10*** | (2006.01) |
| ***A24D 3/02*** | (2006.01) |
| ***A24D 3/04*** | (2006.01) |
| ***A24D 3/06*** | (2006.01) |
| ***A24D 3/14*** | (2006.01) |
| ***A24D 3/17*** | (2020.01) |
| ***D04H 1/26*** | (2012.01) |
| ***D04H 1/28*** | (2012.01) |
| ***D04H 1/4258*** | (2012.01) |
| ***D04H 1/492*** | (2012.01) |

(52) U.S. Cl.
CPC ..... *A24D 3/10* (2013.01); *A24D 3/0245* (2013.01); *A24D 3/04* (2013.01); *A24D 3/068* (2013.01); *A24D 3/14* (2013.01); *A24D 3/17* (2020.01); *D04H 1/26* (2013.01); *D04H 1/28* (2013.01); *D04H 1/4258* (2013.01); *D04H 1/492* (2013.01)

(58) Field of Classification Search
None
See application file for complete search history.

(56) References Cited

U.S. PATENT DOCUMENTS

| | | | | |
|---|---|---|---|---|
| 3,202,155 | A | 8/1965 | Caines et al. | |
| 4,125,061 | A | 11/1978 | Goavec | |
| 4,488,563 | A | 12/1984 | Morifuji et al. | |
| 5,738,119 | A | 4/1998 | Edwards, III et al. | |
| 10,513,826 | B2 | 12/2019 | Latendorf et al. | |
| 11,083,217 | B2 | 8/2021 | Bachmann et al. | |
| 11,214,901 | B2 | 1/2022 | Kellner et al. | |
| 2004/0013859 | A1* | 1/2004 | Annis | D21H 13/08 428/292.1 |
| 2004/0129632 | A1 | 7/2004 | Le Brech et al. | |
| 2008/0295852 | A1 | 12/2008 | Riepert et al. | |
| 2009/0324926 | A1 | 12/2009 | Luo | |
| 2010/0272938 | A1 | 10/2010 | Mitchell et al. | |
| 2015/0001148 | A1 | 1/2015 | Pan et al. | |
| 2015/0374030 | A1* | 12/2015 | Lisauskas | A24D 3/0229 162/146 |
| 2020/0397040 | A1 | 12/2020 | Kitaoka | |
| 2021/0164138 | A1 | 6/2021 | Gregorich et al. | |

FOREIGN PATENT DOCUMENTS

| | | | |
|---|---|---|---|
| CN | 110616505 | A | 12/2019 |
| DE | 1 295 453 | | 5/1969 |
| DE | 10 2005 017 478 | | 10/2006 |
| EP | 2 228 209 | A1 | 9/2010 |
| EP | 2515689 | B1 | 2/2014 |
| EP | 2 985 375 | A1 | 2/2016 |
| EP | 3385425 | A1 | 10/2018 |
| EP | 3 715 515 | A1 | 9/2020 |
| FR | 2 314 679 | | 1/1977 |
| GB | 2 309 466 | A | 7/1997 |
| WO | WO 91/17297 | | 11/1991 |
| WO | 95/14398 | A1 | 6/1995 |
| WO | WO 95/35044 | | 12/1995 |

(Continued)

OTHER PUBLICATIONS

"HydroFormer and AquaJet: A powerful team for wet-laid spunlaced nonwovens," Voith Paper Holding Gmbh & Co KG [E7/E7a—English and German-language versions], (2015), 13 pages.
Additional information on the publication of the Voith brochure: 'For wet-laid and water-jet-bonded nonwovens—HydroFormer and AquaJet', [E7b—English and German-language versions] <URL:https://web.archive.org/web/20191101000000*/https://voith.com/corp-de/productsservices/papermaking-components/hydroformer.html> (2019-2020), 6 pages.
Affidavit of Thomas Weigert (Jun. 2, 2023) [E8a—English and German-language versions], 2 pages.
Program of the 29th Hof Nonwovens Days 2014, Wednesday Program [E8b—German-language version] (Nov. 5, 2014), 2 pages.
Participant List for 29th Hof Nonwovens Days 2014, Nov. 5 & 6, 2014, [E8c] 9 pages.

(Continued)

*Primary Examiner* — Michael H. Wilson
*Assistant Examiner* — Adam Z Baratz
(74) *Attorney, Agent, or Firm* — Barclay Damon LLP

(57) ABSTRACT

The invention relates to a filter material for a smoking product, comprising a nonwoven material, wherein the nonwoven material is hydro-entangled, the hydro-entangled nonwoven material contains min. 50% and max. 90% wood cellulose fibres, min. 10% and max. 50% fibres from regenerated cellulose and less than 30% non-natural polymers, in relation to the mass of the hydro-entangled nonwoven material, and together the amount of wood cellulose fibres and fibres from regenerated cellulose make up at least 70% of the mass of the hydro-entangled nonwoven material, and the hydro-entangled nonwoven material has a density of min 100 kg/m$^3$ and max. 300 kg/m$^3$ and a thickness of min. 100 μm and max. 1000 μm. The invention also relates to a segment with the filter material, a smoking product and a production method.

39 Claims, 1 Drawing Sheet

(56) References Cited

FOREIGN PATENT DOCUMENTS

| | | | |
|---|---|---|---|
| WO | WO 2013/112502 | A1 | 8/2013 |
| WO | 2014/009498 | A1 | 1/2014 |
| WO | WO 2015/178995 | A1 | 11/2015 |
| WO | 2016/120014 | A1 | 8/2016 |
| WO | WO 2017/162347 | | 9/2017 |
| WO | WO 2018/184925 | A1 | 10/2018 |
| WO | WO 2020/025440 | | 2/2020 |
| WO | WO 2020/115219 | A1 | 6/2020 |
| WO | 2021/115619 | A1 | 6/2021 |
| WO | WO 2021/115619 | | 6/2021 |
| WO | WO 2022/018180 | | 1/2022 |
| WO | 2022175261 | A1 | 8/2022 |
| WO | 2022262955 | A1 | 12/2022 |
| WO | 2022263029 | A1 | 12/2022 |
| WO | 2022263030 | A1 | 12/2022 |

OTHER PUBLICATIONS

Weigert & Pöhler, "Wetlaid, Spunlaced Nonwovens. One step beyond Flushable Wipes," [E8] Slide Presentation from 29th Hof Nonwoven Days 2014, Trützschler Nonwovens / Voith (2014), 37 pages.

Affidavit of Thomas Weigert (Jun. 2, 2023) [E9a—English and German-language versions], 2 pages.

Program of the 24th International Munich Paper Symposium: Progress in paper and board production, Mar. 11-13, 2015 [E9b—English and German-language versions], 6 pages.

Participant List for 24th International Munich Paper Symposium, Mar. 11-13, 2015, [E9c] 3 pages.

Weigert & Pöhler, "Paper and Nonwoven Webforming with Wetlaid Spunlace (WLS)," Trützschler Nonwovens / Voith, Slides from 24th International Munich Paper Symposium (IMPS), (2015), [E9] 17 pages.

"Filtration," Sect. 14.2, Excerpt from Ch. 14 of Vliesstoffe: Rohstoffe Herstellung Anwendung / Nonwovens: Raw Materials, Manufacture, Application, Properties and Testing, 2nd ed. [E10—English and German-language versions], Wiley-VCH Verlag & Co. KGaA (pub.), Weinheim, Germany, pp. 572-573, (2012), 6 pages.

International Searching Authority/EP, International Search Report and Written Opinion of the International Searching Authority, Application No. PCT/EP2022/053672, dated Jun. 7, 2022, 16 pages (in German).

International Preliminary Report on Patentability in Application No. PCT/EP2019/085125 dated May 17, 2022 (with English translation), 10 pages.

International Search Report and Written Opinion (with English translation of ISR) in Application No. PCT/EP2021/070473, dated Nov. 12, 2021, 13 pages.

International Preliminary Report on Patentability in Application No. PCT/EP2021/070473 dated Jan. 24, 2023 (with English translation), 13 pages.

International Search Report and Written Opinion in Application No. PCT/EP2022/053672 dated Jun. 7, 2022 [with English translation of ISR], 16 pages.

International Preliminary Report on Patentability in Application No. PCT/EP2022/053672 dated Aug. 22, 2023 (with English translation), 12 pages.

International Search Report and Written Opinion in Application No. PCT/EP2022/057374 dated Oct. 12, 2022 (with English translation of ISR), 27 pages.

International Preliminary Report on Patentability in Application No. PCT/EP2022/057374 dated Dec. 14, 2023 (English translation), 10 pages.

International Search Report and Written Opinion in Application No. PCT/EP2021/066102 dated Mar. 16, 2022 (with English translation of ISR), 21 pages.

International Preliminary Report on Patentability in Application No. PCT/EP2021/066102 dated Dec. 14, 2023, 10 pages.

International Search Report and Written Opinion in Application No. PCT/EP2022/057367 dated Jul. 19, 2022 (with English translation of ISR), 21 pages.

International Preliminary Report on Patentability in Application No. PCT/EP2022/057367 dated Dec. 14, 2023 (English translation), 7 pages.

International Searching Authority/EP, International Search Report and Written Opinion of the International Searching Authority, Application No. PCT/EP2019/085125, mailed May 29, 2020, (with English translation of the International Search Report), 10 pages.

* cited by examiner

HYDRO-ENTANGLED FILTER MATERIAL FOR SMOKING PRODUCTS

CROSS-REFERENCE TO RELATED APPLICATIONS

This application is the national phase entry of International Patent Application No. PCT/EP2019/085125 filed Dec. 13, 2019, the disclosure of which is incorporated herein by reference in its entirety.

FIELD OF THE INVENTION

The invention relates to a filter material and a segment of a smoking article manufactured therefrom, in particular a segment for the filtration of the aerosol flowing in the smoking article, which biodegrade as well, contains fewer additives and processing aids, is optically more homogeneous than segments known in the prior art and can be manufactured inexpensively.

BACKGROUND AND PRIOR ART

Smoking articles are typically rod-shaped articles that consist of at least two rod-shaped segments arranged next to each other. One segment contains a material which is capable of forming an aerosol upon heating and at least one further segment serves to influence properties of the aerosol.

The smoking article can be a filter cigarette, in which a first segment contains the aerosol-forming material, in particular tobacco, and a further segment is designed as a filter and serves to filter the aerosol. In this regard, the aerosol is generated by combustion of the aerosol-forming material and the filter primarily serves to filter the aerosol and to provide a defined draw resistance to the filter cigarette.

The smoking article, however, can also be a so-called heated tobacco product, wherein the aerosol-forming material is only heated but not combusted. In this manner, the number and amount of harmful substances in the aerosol is reduced. Such a smoking article also consists of at least two, more often, however, of more, in particular of four segments. One segment contains the aerosol-forming material, which typically comprises tobacco, reconstituted tobacco or tobacco processed by other methods. Further partially optional segments in the smoking article serve to transfer the aerosol, to cool the aerosol or to filter the aerosol.

The segments are mostly wrapped by a wrapping material. Very often, paper is used as the wrapping material.

Unless explicitly stated or directly clear from the context, the term "segment" as used below should be understood to mean the segment of a smoking article that does not contain the aerosol-forming material, but rather serves, for example, to transfer, cool or filter the aerosol. From the prior art, it is known to form such segments from non-natural polymers such as cellulose acetate or polylactides. After consumption of the smoking article, the smoking article has to be disposed of properly. In many cases, however, the consumer simply discards the consumed smoking article in the environment and attempts to limit this behavior by information or fines has had little success.

Because cellulose acetate and polylactides biodegrade only very slowly, the industry has an interest in manufacturing the segments of smoking articles from other materials which biodegrade better. Furthermore, in the European Union, regulations are under discussion which would substantially reduce or prohibit the use of non-natural polymers in smoking articles, so that for this reason too, there is an interest in having alternative segments for smoking articles available.

It is known in the prior art to manufacture segments for smoking articles, in particular filter segments, from paper. Such segments are generally easily biodegradable, but have other disadvantages. For example, filter segments from paper generally have a high filtration efficiency and thus lead to a dry aerosol, which compromises the taste of the aerosol compared with cigarettes with conventional filter segments produced from cellulose acetate. Furthermore, however, they often have a lower filtration efficiency for phenols than cellulose acetate.

An essential reason for filter segments from paper not having found widespread use so far, however, is their optical appearance. At the mouth end of the smoking article, the cut face of the segment located at the mouth end is visible, and with conventional segments from cellulose acetate, the consumer is used to a homogeneous white surface, in which individual cut fibers are barely recognizable. Segments from paper, however, have a coarse structure, which apparently communicates an impression of lower quality to the consumer. Thus, segments from paper are often only used as one segment in a filter composed of several segments, so that the consumer cannot see the cut face. The segment located at the mouth end is then still often made from cellulose acetate. Because of these optical defects, the advantages of biodegradability of a segment from paper cannot be fully utilized.

It is also known in the prior art to manufacture segments for smoking articles from nonwovens. In EP 2 515 689, for example, a filter material from a nonwoven is described which, however, mainly contains fibers from polyvinyl alcohol, polylactides or other non-natural polymers, and thus cannot fully meet the requirements for biodegradability. Furthermore, the nonwovens described therein are too thin to result in an optically acceptable appearance at the cut face of the segment manufactured therefrom.

In addition, it is known in the prior art to manufacture filter material for smoking articles from paper from easily biodegradable fibers. Such a filter material is described in US 2015/0374030 which, however, consists of a substantial proportion of pulp fibers from hemp, flax, abacá, sisal or cotton. These fibers are expensive and, because of their short growth period compared with wood, their quality varies widely. According to the teachings of US 2015/0374030 they are necessary to provide a sufficiently porous structure and at the same time a sufficiently high strength. The use of wood pulp is discouraged, because it creates a dense and compact paper structure. In fact, the wood pulp content should always be less than 50% by weight and in the industrially implemented embodiments, it is less than 5% by weight. In addition, due to the manufacturing process used, the optical appearance of such filters is also not sufficiently appealing to the consumer.

Thus, there is an interest in the industry for a filter material to be available from which segments can be produced which are biodegradable, have a good optical appearance and can be manufactured inexpensively and in high quality on an industrial scale.

SUMMARY OF THE INVENTION

The object of the invention is to provide a filter material for a smoking article which biodegrades well and from which segments for a smoking article can be manufactured, the optical appearance of which compares well with that of conventional segments, in particular those produced from cellulose acetate, and which in addition can be manufactured from readily available and inexpensive raw materials. Undesirable influences on the taste of the smoking article should therefore be minimized.

This object is achieved by a filter material according to claim 1, a segment of a smoking article according to claim 23, the manufacturing process thereof according to claim 32, and a smoking article according to claim 33, as well as by a process according to claim 36 for manufacturing a hydro-entangled nonwoven. Advantageous embodiments are defined in the dependent claims.

The inventors have found that this object can be achieved by specific nonwovens. In particular, the object can be achieved by a filter material that comprises a nonwoven, wherein the nonwoven is hydro-entangled and the hydro-entangled nonwoven contains at least 50% and at most 100% wood pulp fibers, at least 10% and at most 50% fibers from regenerated cellulose and less than 30% non-natural polymers, and the amount of wood pulp fibers and fibers from regenerated cellulose together make up at least 70% of the mass of the hydro-entangled nonwoven and the hydro-entangled nonwoven has a density of at least 100 $kg/m^3$ and at most 300 $kg/m^3$ and a thickness of at least 100 μm and at most 1000 μm. In this regard, all percentages refer to the mass of the hydro-entangled nonwoven.

Although the term "hydro-entangled" at first indicates the underlying manufacturing process, it has to be considered that a hydro-entangled nonwoven has characteristic structural properties which distinguish it from other fibrous webs or nonwovens and which, to the knowledge of the inventors, cannot be achieved in an identical manner by other manufacturing processes. Other than for paper, for example, wherein the strength is primarily due to hydrogen bonds and the fibers are mainly arranged in the plane of the paper, the strength of the hydro-entangled nonwoven is achieved by entanglement of the fibers, and thus a substantial proportion of the fibers are also oriented in the thickness direction of the nonwoven.

In contrast to the teachings of the prior art, the inventors have found that a filter material with a high proportion of wood pulp fibers can be manufactured without making the structure of the nonwoven too dense or too compact. According to the invention, this is essentially achieved by the use of a hydro-entangled nonwoven, which contains fibers of regenerated cellulose in addition to wood pulp fibers.

During manufacture of the hydro-entangled nonwoven according to the invention, the fibers are laid on a water-permeable wire and are entangled by a water jet directed onto the fibers. This generates a porous structure with a very low density and large thickness, which is particularly well suited as a filter material. In particular, such a filter material that is suitable for segments of smoking articles can be manufactured with a high proportion of wood pulp fibers and thus inexpensively, and a segment for a smoking article manufactured from the filter material according to the invention has a homogeneous cross section which compares well with that of a segment from cellulose acetate. Furthermore, in contrast to paper, the addition of additives or processing aids for the manufacture of the hydro-entangled nonwoven is not necessary. This means that an undesirable influence of such additives or processing aids on the taste of a smoking article manufactured by means of the filter material according to the invention is avoided and the biodegradability is not compromised.

In order to set the draw resistance and the filtration efficiency of a segment manufactured from the filter material, and also to set a good tensile strength for the hydro-entangled nonwoven, the hydro-entangled nonwoven contained in the filter material according to the invention contains a high proportion of wood pulp fibers and fibers from regenerated cellulose, which together make up at least 70% of the mass of the hydro-entangled nonwoven.

Because wood pulp fibers and also regenerated cellulose consist of natural polymers, they also biodegrade well. In order to ensure the good biodegradability of the filter material according to the invention and of the segment for smoking articles manufactured therefrom, the proportion of non-natural polymers should be less than 30% of the mass of the hydro-entangled nonwoven.

In this regard, natural polymers are polymers that are sourced directly from natural raw materials without any chemical modification or modification of the composition, or are chemically identical to such polymers sourced from nature. Specifically, wood pulp fibers consist of natural polymers; fibers from regenerated cellulose are also natural polymers. For cellulose acetate or polylactides, however, chemical modifications have taken place and so they are not natural polymers and, although the raw materials occur in nature, these raw materials have at least been modified in such a way that rapid biodegradability is no longer guaranteed. In addition, all polymers sourced from mineral oil, such as polyethylene, polypropylene, polyester or polystyrene, are non-natural polymers.

The hydro-entangled nonwoven contained in the filter material according to the invention contains wood pulp fibers in an amount of at least 50% and at most 90% of the mass of the hydro-entangled nonwoven. Preferably, the proportion of wood pulp fibers is at least 60% and at most 80% and particularly preferably at least 60% and at most 70%, respectively with respect to the mass of the hydro-entangled nonwoven.

Wood pulp fibers are pulp fibers sourced from coniferous or deciduous trees. They are produced industrially in large quantities, have a stable quality and are inexpensive. Preferably, the wood pulp fibers are sourced from coniferous trees such as spruce, pine or fir because, due to their length, these fibers produce good strength in the hydro-entangled nonwoven. Preferably, suitable wood pulp fibers for the invention are sourced from deciduous trees such as birch, beech or eucalyptus. Preferably, mixtures of wood pulp fibers from various sources can be used. Wood pulp fibers sourced from coniferous trees, known as reinforced pulp fibers and having particularly high strength, as well as mercerized wood pulp fiber, which produce a particularly large thickness and low density, are particularly preferred.

Pulp fibers from other plants such as hemp, flax, jute, ramie, abacá, sisal, cotton or esparto grass are not counted as wood pulp fibers in the context of this invention. In fact, a porous paper structure and high strength can also be produced with these fibers. However, these fibers are expensive, not always readily available industrially and, because of the short growth period of these plants, they are of variable quality. They can be contained in the hydro-entangled nonwoven according to the invention, but their proportion should preferably be at most 20% and particularly preferably at most 10% and in particular at most 1% of the mass of the hydro-entangled nonwoven.

The wood pulp fibers can be bleached or unbleached. Due to their white color, bleached wood pulp fibers offer advantages as regards the optical appearance of a segment manufactured from the filter material according to the invention, while unbleached wood pulp fibers, which then have a light brown to dark brown color, are more environmentally friendly, because they do not need a bleaching process. Mixtures of bleached and unbleached wood pulp fibers can also be used for a better adjustment of the color of the filter material according to the invention.

The hydro-entangled nonwoven that is contained in the filter material according to the invention contains fibers from regenerated cellulose in an amount of at least 10% and at most 50% of the mass of the hydro-entangled nonwoven. Preferably, the proportion of fibers from regenerated cellulose is at least 20% and at most 45% and particularly preferably at least 30% and at most 40%, respectively with respect to the mass of the hydro-entangled nonwoven.

The fibers produced from regenerated cellulose are preferably viscose fibers, Modal fibers, Lyocell®, Tencel® or mixtures thereof. These fibers have good biodegradability and can be used to optimize the strength, thickness or density of the hydro-entangled nonwoven and to adjust the filtration efficiency of the segment manufactured therefrom for the smoking article.

The sum of the amounts of wood pulp fibers and fibers from regenerated cellulose together should be at least 70%, preferably at least 80% and particularly preferably at least 90% of the mass of the hydro-entangled nonwoven. In a highly particularly preferred embodiment, the filter material according to the invention comprises a hydro-entangled nonwoven which essentially consists exclusively, but at least to 95% with respect to the mass of the hydro-entangled nonwoven, of wood pulp fibers and fibers from regenerated cellulose. This highly particularly preferred embodiment provides the best biodegradability and at the same time a very minor influence on the taste of the smoking article manufactured by means of the filter material.

In order to ensure the good biodegradability, the hydro-entangled nonwoven should contain less than 30% non-natural polymers. Preferably, the hydro-entangled nonwoven contains less than 10% non-natural polymers and particularly preferably less than 1% non-natural polymers. The percentages refer to the mass of the hydro-entangled nonwoven.

In a preferred embodiment of the filter material according to the invention, the hydro-entangled nonwoven of the filter material contains at least 5% and less than 30%, particularly preferably less than 25% and highly particularly preferably less than 20% staple fibers from cellulose acetate, wherein the percentages refer to the mass of the hydro-entangled nonwoven.

Additives such as alkylketene dimers (AKD), alkenyl succinic acid anhydrides (ASA), fatty acids, starch, starch derivatives, carboxymethyl cellulose, alginates, or pH-adjusting substances, such as organic or inorganic acids or bases, for example, can be added to adjust specific properties of the nonwoven, as long as the mass of non-natural polymers in the nonwoven is not more than 30%. The skilled person is able to determine the type and amount of such additives by his experience.

The basis weight of the hydro-entangled nonwoven is preferably at least 25 g/m$^2$ and at most 150 g/m$^2$, particularly preferably at least 35 g/m$^2$ and at most 120 g/m$^2$ and highly particularly preferably at least 40 g/m$^2$ and at most 80 g/m$^2$. The basis weight influences the tensile strength of the hydro-entangled nonwoven, whereas a higher basis weight leads to greater strength. These values refer to a basis weight, which is measured in accordance with ISO 536:2012.

The thickness of the hydro-entangled nonwoven, measured in accordance with ISO 534:2011, is at least 100 μm and at most 1000 μm, preferably at least 120 μm and at most 800 μm, particularly preferably at least 150 m and at most 750 m. The thickness influences the amount of filter material which can be packed into the segment of the smoking article and therefore the draw resistance and filtration efficiency of the segment, but also the processability of the filter material, because it is often crimped or folded for the manufacture of a segment for a smoking article. For such process steps, a large thickness is disadvantageous and thicknesses in the preferred and particularly preferred intervals allow for particularly good processability of the filter material according to the invention to a segment of a smoking article.

The density of the hydro-entangled nonwoven is calculated by dividing the basis weight in accordance with ISO 536:2012 by the thickness in accordance with ISO 534:2011. The density of the hydro-entangled nonwoven determined thereby is at least 100 kg/m$^3$ and at most 300 kg/m$^3$, preferably at least 120 kg/m$^2$ and at most 250 kg/m$^2$ and particularly preferably at least 140 kg/m$^2$ and at most 220 kg/m$^3$. These values refer to the thickness before a segment of a smoking article is manufactured from the filter material according to the invention which comprises this hydro-entangled nonwoven. The density of the hydro-entangled nonwoven should be in a comparably narrow interval, because it determines the draw resistance and the filtration efficiency of the segment of a smoking article manufactured therefrom. The preferred and particularly preferred intervals allow for an even better combination of draw resistance and filtration efficiency.

The air permeability of the hydro-entangled nonwoven, measured in accordance with ISO 2965:2019, can preferably be between 10000 cm$^3$/(cm$^2$·kPa·min) and 60000 cm$^3$/(cm$^2$·kPa·min), particularly preferably between 20000 cm$^3$/(cm$^2$·kPa·min) and 50000 cm$^3$/(cm$^2$·kPa·min) and highly particularly preferably between 35000 cm$^3$/(cm$^2$·kPa·min) and 45000 cm$^3$/(cm$^2$·kPa·min). The air permeability describes the porous structure of the hydro-entangled nonwoven and therefore also influences the filtration efficiency and the draw resistance.

The mechanical properties of the hydro-entangled nonwoven are of importance in processing the filter material according to the invention to form a segment of a smoking article. The tensile strength, referred to the width, of the hydro-entangled nonwoven, measured in accordance with ISO 1924-2:2008, is preferably at least 0.05 kN/m and at most 5 kN/m, particularly preferably at least 0.07 kN/m and at most 4 kN/m.

The elongation at break of the hydro-entangled nonwoven is of importance, because when processing the filter material according to the invention to form a segment of a smoking article, the filter material is often crimped and therefore a particularly high elongation at break is of advantage. The elongation at break of the hydro-entangled nonwoven, measured in accordance with ISO 1924-2:2008, is preferably at least 1% and at most 50% and particularly preferably at least 3% and at most 40%.

Because the hydro-entangled nonwoven can also be stretched during processing, its energy absorption plays a role. The energy absorption of the hydro-entangled nonwoven, measured in accordance with ISO 1924-2:2008, is preferably at least 4 J/m$^2$ and at most 500 J/m$^2$ and particularly preferably at least 5 J/m$^2$ and at most 450 J/m$^2$.

Tensile strength, elongation at break and energy absorption can depend on the direction in which the sample for the measurement is taken from the hydro-entangled nonwoven. The cited features of the hydro-entangled nonwoven are each present if tensile strength, elongation at break or energy absorption lie in at least one direction in said preferred or particularly preferred intervals.

The filter material according to the invention comprises the hydro-entangled nonwoven.

Preferably, however, the hydro-entangled nonwoven makes up the predominant part of the filter material, so that preferably, at least 90% of the mass of the filter material is formed by the hydro-entangled nonwoven and particularly preferably at least 95% of the mass of the filter material is formed by the hydro-entangled nonwoven.

In addition to the hydro-entangled nonwoven, the filter material according to the invention can further comprise other components which, for example, influence the processability of the filter material or the properties of a segment manufactured thereof or the taste of the smoking article. This includes, for example, carriers for flavors, in particular filaments impregnated with flavors, or substances to increase the stiffness of the filter material, or other materials which increase the hardness of the filter manufactured from the filter material; thermoplastic materials are an example.

In a preferred embodiment of the filter material according to the invention, the filter material comprises the hydro-entangled nonwoven and a substance selected from the group consisting of triacetin, propylene glycol, sorbitol, glycerol, polyethylene glycol, polyvinyl alcohol, triethyl citrate, or mixtures thereof. These substances can help to match the filtration efficiency to that of cellulose acetate better.

As long as at least 90% of the mass of the filter material is formed by the hydro-entangled nonwoven, the fulfillment of the aforementioned features of the hydro-entangled nonwoven, for example with respect to the content of wood pulp fibers, the content of fibers from regenerated cellulose, the amount of wood pulp fibers and fibers from regenerated cellulose, the proportion of non-natural polymers, the content of other pulp fibers, the thickness, the density, the basis weight, the air permeability, the tensile strength, the elongation at break and the energy absorption, can be checked on the filter material itself without having to isolate the hydro-entangled nonwoven from the filter material. The aforementioned intervals and properties then also apply to the filter material manufactured from the hydro-entangled nonwoven.

Segments for smoking articles according to the invention can be manufactured from the filter material according to the invention by processes which are known in the art. These processes comprise, for example, crimping or folding the filter material, forming a continuous tow from the crimped or folded filter material, wrapping the continuous tow with a wrapping material and cutting the wrapped tow into individual rods of defined length. In many cases, the length of such a rod is whole-number multiple of the length of the segment which should then be used in the smoking article according to the invention, and therefore the rods are then cut into segments of desired length before or during the manufacture of the smoking articles.

The segment for smoking articles according to the invention comprises the filter material according to the invention and a wrapping material.

In a preferred embodiment of the segment according to the invention, the segment is cylindrical with a diameter of at least 3 mm and at most 10 mm, particularly preferably of at least 4 mm and at most 9 mm and highly particularly preferably of at least 5 mm and at most 8 mm. These diameters are advantageous for using the segments according to the invention in smoking articles.

In a preferred embodiment of the segment according to the invention, the segment has a length of at least 4 mm and at most 40 mm, particularly preferably of at least 6 mm and at most 35 mm and highly particularly preferably of at least 10 mm and at most 28 mm.

The draw resistance of the segment determines, inter alia, which pressure difference the smoker needs to apply during consumption of the smoking article to draw a certain volumetric flow through the smoking article, and thus it essentially influences the acceptance of the smoking article by the smoker. The draw resistance of the segment can be measured in accordance with ISO 6565:2015 and is given in mm water gauge (mmWG). To a very good approximation, the draw resistance of the segment is proportional to the length of the segment, so that the measurement of the draw resistance can also be carried out on rods, which differ from the segment only with respect to their length. From this, the draw resistance of the segment can easily be calculated.

The draw resistance of the segment per unit length of the segment is preferably at least 1 mmWG/mm and at most 12 mmWG/mm and particularly preferably at least 2 mmWG/mm and at most 10 mmWG/mm.

The density of the segment itself, without the wrapping material, is preferably between 50 kg/m$^3$ and 300 kg/m$^3$, particularly preferably between 60 kg/m$^3$ and 250 kg/m$^3$ and highly particularly preferably between 70 kg/m$^3$ and 230 kg/m$^3$. The density has substantial effects on the draw resistance, the filtration efficiency and the hardness of the segments. The density of the segment is given without the wrapping material, because the wrapping material has little influence on the draw resistance or the filtration efficiency. The determination of the density of the segment can be by calculation. In this regard, firstly, the volume of the segment is determined which, for example for a cylindrical segment, can be calculated from the diameter and the length. The influence of the wrapping material on the diameter can be neglected. The mass of the segment can be determined by weighing, wherein the segment is wrapped by the wrapping material. The mass of the wrapping material can be determined from the area of the wrapping material and the nominal or measured basis weight of the wrapping material. As an example, for a typical cylindrical segment, the area of the wrapping material results from the circumference of the segment and the overlap of the wrapping material with itself as well as the length of the segment.

The mass of the wrapping material is deducted from the mass of the segment including the wrapping material and its density is calculated by dividing by the volume of the segment. A detailed numerical example is provided further below.

The wrapping material of the segment according to the invention is preferably a paper or a film. In order not to deteriorate the good biodegradability of the segment, in a particularly preferred embodiment, the paper or the film contains less than 10% non-natural polymers with respect to the mass of the wrapping material.

The wrapping material of the segment according to the invention preferably has a basis weight of at least 20 g/m$^2$ and at most 150 g/m$^2$, particularly preferably of at least 30 g/m$^2$ and at most 130 g/m$^2$. A wrapping material with this preferred or particularly preferred basis weight provides a particularly advantageous hardness to the segment according to the invention wrapped therein. Because of this, the smoker cannot accidentally compress the segment located in the smoking article.

In a preferred embodiment, the segment according to the invention additionally contains at least one capsule which contains flavors. Often, the capsule is designed such that the smoker can break it by pressure with the fingers and thereby release the flavors, so that they can modify the taste of the smoking article.

Smoking articles according to the invention can be manufactured from the segment according to the invention using processes which are known in the art.

The smoking article according to the invention comprises a segment that contains an aerosol-forming material, and a segment that comprises the filter material according to the invention and a wrapping material.

Because the cut face of the segment according to the invention is optically very similar to a segment produced from cellulose acetate, in a preferred embodiment, the segment located next to the mouth end of the smoking article is a segment according to the invention.

In a preferred embodiment, the smoking article is a filter cigarette and the aerosol-forming material is tobacco.

In a preferred embodiment, the smoking article is a smoking article in which, during its intended use, the aerosol-forming material is only heated, but not combusted.

The hydro-entangled nonwoven for the filter material according to the invention can be manufactured according to the following process according to the invention, which comprises the following steps A to F.

A—producing an aqueous suspension comprising wood pulp fibers and fibers produced from regenerated cellulose, wherein the amount of wood pulp fibers and fibers produced from regenerated cellulose together makes up at least 70% of the mass of the solids in the suspension B—applying the suspension from step A to a running wire C—de-watering the suspension through the running wire to form a fiber web D—transferring the fiber web from step C to a support wire E—hydro-entangling the fiber web by means of at least one water jet directed onto the fiber web to form a hydro-entangled nonwoven F—drying the hydro-entangled nonwoven.

The hydro-entangled nonwoven manufactured according to this process is suitable for use in the filter material described above. This means that it can in particular have all of the features, individually or in combination, which were described above in the context of the hydro-entangled nonwoven as a component of the filter material and are defined in the claims directed to the filter material.

In a preferred embodiment of the process according to the invention, the aqueous suspension in step A has a solid content of at most 3.0%, particularly preferably at most 1.0%, highly particularly preferably at most 0.2% and in particular at most 0.05%. The particularly low solids content of the suspension enables a fiber web with an even lower density to be formed in step C.

In a preferred embodiment of the process according to the invention, the running wire of steps B and C is inclined upwards with respect to the horizontal in the running direction of the fiber web by an angle of at least 3° and at most 40°, particularly preferably by an angle of at least 5° and at most 30° and highly particularly preferably by an angle of at least 15° and at most 25°.

In a preferred embodiment, the process comprises a step in which a pressure difference is applied between the two sides of the running wire in order to support de-watering of the suspension in step C, wherein particularly preferably, vacuum boxes or suitably shaped vanes generate the pressure difference.

In a preferred embodiment of the process according to the invention, a plurality of water jets is used to carry out the hydro-entangling in step E, wherein the water jets are arranged in at least one row orthogonal to the running direction of the fiber web.

In a preferred embodiment of the process according to the invention, the hydro-entangling in step E is carried out by at least two water jets directed onto the fiber web, wherein particularly preferably, the at least two water jets act on different sides of the fiber web.

In a preferred embodiment of the process according to the invention, the drying in step F is carried out at least partially by contact with hot air, by infra-red radiation or by microwave radiation. Drying by direct contact with a heated surface is also possible, but is less preferred, because the thickness of the hydro-entangled nonwoven could be reduced thereby.

DESCRIPTION OF THE PREFERRED EMBODIMENTS

Some preferred embodiments of the filter material, the segment for smoking articles, the smoking article and the process for the manufacture of the hydro-entangled nonwoven are described below.

Figure 1:
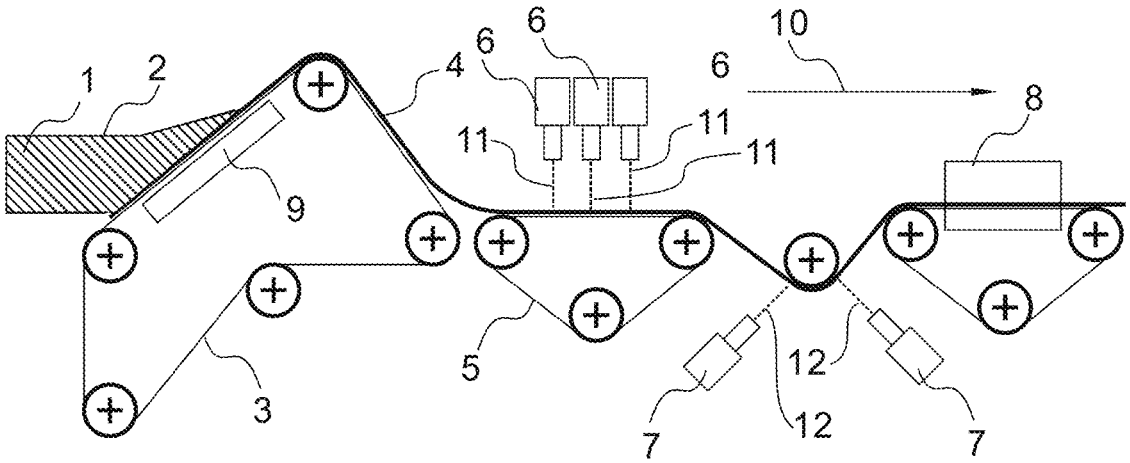
FIG. 1 shows an arrangement by means of which the process according to the invention for the manufacture of the hydro-entangled nonwoven can be carried out.

For the manufacture of the hydro-entangled nonwoven which is contained in the filter material according to the invention, the process shown in FIG. 1 was used.

A suspension 1 produced from wood pulp fibers and fibers from regenerated cellulose was pumped from a head box 2 onto a running wire 3, inclined upwards with respect to the horizontal, and de-watered by vacuum boxes 9, so that a fiber web 4 was formed on the wire, the general direction of movement of which is indicated by arrow 10. The fiber web 4 was removed from wire 3 and transferred to a support wire 5 which was also running. In this, water jets 11 arranged in several rows orthogonal to the running direction of the fiber web 4 were directed onto the fiber web 4 from devices 6 in order to entangle the fibers and consolidate the fiber web 4 into a nonwoven. In a further step, water jets 12 were also directed onto the other side of the fiber web 4 by additional devices 7, in order to further entangle the emerging nonwoven. The still-wet nonwoven then ran through drying equipment 8 and was dried there.

To manufacture the hydro-entangled nonwoven, mixtures of wood pulp fibers and Lyocell® fibers where used. Five different hydro-entangled nonwovens A to E were manufactured; their composition and properties are provided in Table 1. In this regard, the percentages in relation to Lyocell® fibers and wood pulp fibers indicate the amount of fibers with respect to the mass of the hydro-entangled nonwoven. The elongation at break and the energy absorption are each given in the machine direction (MD), i.e. in the direction indicated by arrow 10 in FIG. 1, and in the cross direction (CD) orthogonal thereto and lying in the plane of the fiber web 4.

TABLE 1

| Filter Material | | Nonwoven A A | B B | C C | D D | E E |
|---|---|---|---|---|---|---|
| Lyocell ® Fibers | % | 20 | 20 | 40 | 40 | 40 |
| Wood Pulp Fibers | % | 80 | 80 | 60 | 60 | 60 |
| Basis Weight | $g/m^2$ | 40 | 60 | 80 | 120 | 50 |
| Thickness | μm | 257 | 345 | 497 | 688 | 299 |
| Density | $kg/m^3$ | 156 | 174 | 161 | 175 | 167 |
| Tensile Strength | kN/m | 0.23 | 0.38 | 1.60 | 2.83 | 1.15 |
| Elongation at Break MD | % | 6.6 | 7.0 | 12.4 | 20.0 | 15.5 |
| Elongation at Break CD | % | 28.1 | 21.7 | 29.8 | 42.3 | |
| Energy Absorption MD | $J/m^2$ | 13.9 | 22.6 | 95.6 | 386.8 | 128.7 |
| Energy Absorption CD | $J/m^2$ | 20.9 | 40.1 | 143.0 | 333.5 | |

The hydro-entangled nonwovens A to E were each used as filter material according to the invention A to E without adding further components.

From filter material E according to the invention, three segments S1, S2 and S3 with different densities were manufactured, wherein each filter material was formed into a continuous tow with a diameter of 7.9 mm and wrapped with a wrapping material with a basis weight of 78 $g/m^2$. The continuous tow was initially cut into rods with a length of 108 mm. The mean mass of the rods and the mean draw resistance of the rods, in accordance with ISO 6565:2015, were determined and the density without the wrapping material and the draw resistance per unit length were calculated therefrom. Next, the rods were cut into segments according to the invention with a length of 22 mm. Table 2 shows the data for the segments S1, S2 and S3. An exemplary calculation of the density of the segment is explained in more detail using segment S1.

The measured mass of the 108 mm long rod of segment S1 was 0.743 g. The diameter was 7.9 mm. From this, ignoring the thickness of the wrapping material, this gave a volume for the rod of $\pi/4\times7.9^2\times108=5293\ mm^3$ The mass of the 27 mm wide and 108 mm long wrapping material with a basis weight of 78 $g/m^2$ was $78\times0.027\times0.108=0.227$ g.

The density of the segment without the wrapping material is therefore $(0.743-0.227)/5293=97.5\ kg/m^3$.

TABLE 2

| Filter Material | | E | E | E |
|---|---|---|---|---|
| Segment | | S1 | S2 | S3 |
| Mass (108 mm) | mg | 743 | 911 | 1199 |
| Density | $kg/m^3$ | 97.5 | 129.4 | 182.9 |
| Draw Resistance | mm WG/mm | 1.76 | 4.16 | 11.12 |

Figure 2:
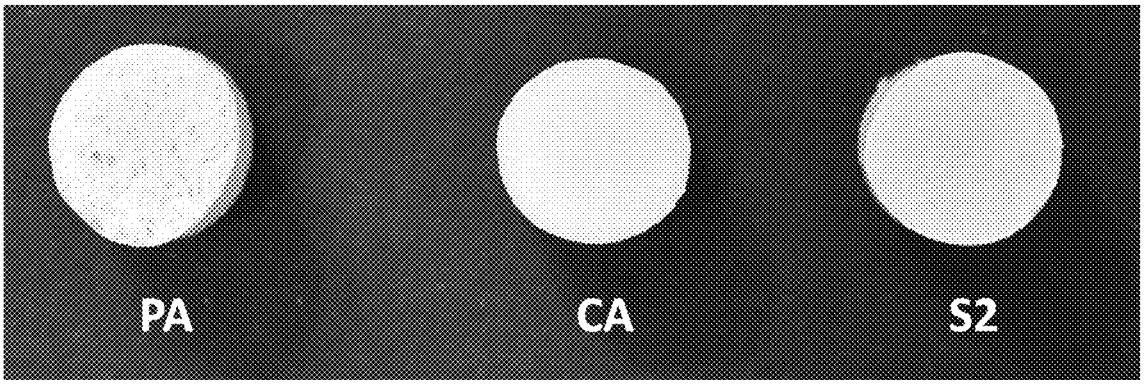
FIG. 2 shows the cross section of a segment according to the invention in comparison with a segment produced from cellulose acetate and a segment produced from paper.

FIG. 2 shows photographs of the cross sectional area of segment S2 according to the invention as well as of two comparable segments from cellulose acetate (CA) and paper (PA). For the segment produced from paper, the coarse structure of the cross-sectional area is clearly visible, while the segment produced from cellulose acetate exhibits a very fine structure. The segment S2 according to the invention is substantially closer to that of cellulose acetate (CA) in its optical appearance and thus results in a much more acceptable optical impression than the segment produced from paper (PA).

From each of the segments S1, S2 and S3 according to the invention, non-ventilated smoking articles R1, R2 and R3 according to the invention with a length of 83 mm were manufactured, which contained a segment with tobacco and a filter segment. The filter segment was formed by one of each of the segments S1, S2 and S3 according to the invention. The smoking articles R1, R2 and R3 were smoked in accordance with the method specified in ISO 3308 and the amount of tar, nicotine and water in the smoke were determined. An identical smoking article, in which the filter was formed by a conventional filter segment from cellulose acetate, was smoked according to the same method. A comparison of the amount of tar, nicotine and water showed that the filter segments S1, S2 and S3 agree well with a filter segment produced from cellulose acetate having regard to their filtration efficiency.

In addition, the draw resistances of the segments S1, S2 and S3 were in an advantageous range for a smoking article and can easily be adjusted to requirements by the density of the segment, even for a given composition of the segments.

The biodegradability of the segments S1, S2 and S3, as well as of the smoking articles R1, R2 and R3 produced therefrom was not separately tested, because this is given by the components used.

This shows that filter materials according to the invention, which contain a hydro-entangled nonwoven, offer advantages with respect to biodegradability and optical appearance compared with filter materials which are known in the art, without being limited in their function as filter, and furthermore can be manufactured industrially and inexpensively from readily available raw materials.

The invention claimed is:

1. Filter material for a smoking article, which comprises a nonwoven, characterized in that the nonwoven is hydro-entangled, the hydro-entangled nonwoven contains at least 50% and at most 90% wood pulp fibers, at least 10% and at most 50% fibers from regenerated cellulose and less than 30% non-natural polymers, respectively with respect to the mass of the hydro-entangled nonwoven, and the amount of wood pulp fibers and fibers from regenerated cellulose together makes up at least 70% of the mass of the hydro-entangled nonwoven, and the hydro-entangled nonwoven has a density of at least 100 $kg/m^3$ and at most 300 $kg/m^3$ and a thickness of at least 100 μm and at most 1000 μm, wherein the thickness is measured in accordance with ISO 534:2011 and the density of the hydro-entangled nonwoven is determined by dividing the basis weight in accordance with ISO 536:2012 by the thickness in accordance with ISO 534:2011, wherein the wood pulp fibers are at least partially bleached.

2. Filter material according to claim 1, wherein the proportion of wood pulp fibers in the hydro-entangled nonwoven is at least 60% and at most 80% with respect to the mass of the hydro-entangled nonwoven.

3. Filter material according to claim 1, wherein the wood pulp fibers are at least partially formed by mercerized wood pulp fibers.

4. Filter material according to claim 1, wherein the proportion of fibers produced from regenerated cellulose in the hydro-entangled nonwoven is at least 20% and at most 45% with respect to the mass of the hydro-entangled nonwoven.

5. Filter material according to claim 1, wherein the sum of the amounts of wood pulp fibers and fibers from regenerated cellulose together makes up at least 80% of the mass of the hydro-entangled nonwoven.

6. Filter material according to claim 1, wherein the hydro-entangled nonwoven contains at least 5% and less than 30% staple fibers from cellulose acetate with respect to the mass of the hydro-entangled nonwoven.

7. Filter material according to claim 1, wherein the hydro-entangled nonwoven has a basis weight in accordance with ISO 536:2012 of at least 25 g/m$^2$ and at most 150 g/m$^2$.

8. Filter material according to claim 1, wherein the thickness of the hydro-entangled nonwoven in accordance with ISO 534:2011 is at least 120 μm and at most 800 μm.

9. Filter material according to claim 1, wherein a tensile strength with respect to the width of the hydro-entangled nonwoven in accordance with ISO 1924-2:2008 in at least one direction is at least 0.05 kN/m and at most 5 kN/m.

10. Filter material according to claim 1, wherein at least 90% of the mass of the filter material is formed by the hydro-entangled nonwoven.

11. Filter material according to claim 1, wherein the filter material comprises the hydro-entangled nonwoven and a substance selected from the group consisting of triacetin, propylene glycol, sorbitol, glycerol, polyethylene glycol, polyvinyl alcohol and tri-ethyl citrate or mixtures thereof.

12. Filter material according to claim 1, wherein a content of pulp fibers from hemp, flax, jute, ramie, abacá, sisal or cotton is a total of at most 1% of the mass of the hydro-entangled nonwoven.

13. Filter material according to claim 1, wherein the sum of the amounts of wood pulp fibers and fibers from regenerated cellulose together makes up at least 95% of the mass of the hydro-entangled nonwoven.

14. Filter material according to claim 1, wherein the hydro-entangled nonwoven contains less than 1% non-natural polymers with respect to the mass of the hydro-entangled nonwoven.

15. Filter material according to claim 1, wherein the hydro-entangled nonwoven has an air permeability in accordance with ISO 2965:2019 of between 35000 cm$^3$/(cm$^2$·kPa·min) and 45000 cm$^3$/(cm$^2$·kPa·min).

16. Segment of a smoking article, comprising the filter material of claim 1 and a wrapping material.

17. Segment according to claim 16, wherein the segment is cylindrical with a diameter of at least 3 mm and at most 10 mm, and wherein the segment has a length of at least 4 mm and at most 40 mm.

18. Segment according to claim 16, wherein the draw resistance of the segment in accordance with ISO 6565:2015 per unit length of the segment is at least 1 mmWG/mm and at most 12 mmWG/mm.

19. Segment according to claim 16, with a density without the wrapping material of between 50 kg/m$^3$ and 300 kg/m$^3$.

20. Segment according to claim 16, the wrapping material of which has a basis weight in accordance with ISO 536:2012 of at least 20 g/m$^2$ and at most 150 g/m$^2$.

21. Smoking article comprising a segment which contains an aerosol-forming material and a segment according to claim 16.

22. Smoking article according to claim 21, wherein the smoking articles is a filter cigarette and the aerosol-forming material is or contains tobacco.

23. Smoking article according to claim 21, wherein the smoking article is a smoking article wherein, during its intended use, the aerosol-forming material is only heated but not combusted.

24. Smoking article according to claim 21, wherein said segment according to claim 16 forms the segment of the smoking article located next to the mouth end.

25. Filter material for a smoking article, which comprises a nonwoven, characterized in that the nonwoven is hydro-entangled, the hydro-entangled nonwoven contains at least 50% and at most 90% wood pulp fibers, at least 10% and at most 50% fibers from regenerated cellulose and less than 30% non-natural polymers, respectively with respect to the mass of the hydro-entangled nonwoven, and the amount of wood pulp fibers and fibers from regenerated cellulose together makes up at least 70% of the mass of the hydro-entangled nonwoven, and the hydro-entangled nonwoven has a density of at least 100 kg/m$^3$ and at most 300 kg/m$^3$ and a thickness of at least 100 μm and at most 1000 μm, wherein the thickness is measured in accordance with ISO 534:2011 and the density of the hydro-entangled nonwoven is determined by dividing the basis weight in accordance with ISO 536:2012 by the thickness in accordance with ISO 534:2011, wherein the elongation at break of the hydro-entangled nonwoven in accordance with ISO 1924-2:2008 in at least one direction is at least 1% and at most 50%.

26. Filter material for a smoking article, which comprises a nonwoven, characterized in that the nonwoven is hydro-entangled, the hydro-entangled nonwoven contains at least 50% and at most 90% wood pulp fibers, at least 10% and at most 50% fibers from regenerated cellulose and less than 30% non-natural polymers, respectively with respect to the mass of the hydro-entangled nonwoven, and the amount of wood pulp fibers and fibers from regenerated cellulose together makes up at least 70% of the mass of the hydro-entangled nonwoven, and the hydro-entangled nonwoven has a density of at least 100 kg/m$^3$ and at most 300 kg/m$^3$ and a thickness of at least 100 μm and at most 1000 μm, wherein the thickness is measured in accordance with ISO 534:2011 and the density of the hydro-entangled nonwoven is determined by dividing the basis weight in accordance with ISO 536:2012 by the thickness in accordance with ISO 534:2011, wherein the hydro-entangled nonwoven has an energy absorption in accordance with ISO 1924-2:2008 in at least one direction of at least 4 J/m$^2$ and at most 500 J/m$^2$.

27. Process for the production of a hydro-entangled nonwoven, wherein the process comprises the following steps:

A—producing an aqueous suspension comprising wood pulp fibers and fibers from regenerated cellulose, wherein the wood pulp fibers are at least partially bleached, B—applying the suspension from step A to a running wire, C—de-watering the suspension through the running wire, to form a fiber web, D—transferring the fiber web from step C to a support wire, E—hydro-entangling the fiber web by means of at least one water jet directed onto the fiber web, in order to manufacture the hydro-entangled nonwoven and F—drying the hydro-entangled nonwoven, wherein the amount of wood pulp fibers and fibers from regenerated cellulose together makes up at least 70% of the mass of the solids in the suspension of step A, wherein the hydro-entangled nonwoven contains at least 50% and at most 90% wood pulp fibers, at least 10% and at most 50% fibers from regenerated cellulose and less than 30% non-natural polymers, respectively with respect to the mass of the finished hydro-entangled nonwoven, and wherein the hydro-entangled nonwoven has a density of at least 100 kg/m$^3$ and at most 300 kg/m$^3$ and a thickness of least 100 μm and at most 1000 μm, wherein the thickness is measured in accordance with ISO 534: 2011 and the density of the hydro-entangled nonwoven is determined by dividing the basis weight in accordance with ISO 536:2012 by the thickness in accordance with ISO 534:2011.

28. Process according to claim 27, wherein the hydro-entangled nonwoven produced by the process is suitable for the use in a filter material according to claim 1.

29. Process according to claim 27, wherein the thickness of the hydro-entangled nonwoven in accordance with ISO 534:2011 is at least 120 μm and at most 800 μm.

30. Process according to claim 27, wherein the proportion of wood pulp fibers in the hydro-entangled nonwoven is at least 60% and at most 80% with respect to the mass of the hydro-entangled nonwoven.

31. Process according to claim 27, wherein the proportion of fibers from regenerated cellulose in the hydro-entangled nonwoven is at least 20% and at most 45% with respect to the mass of the hydro-entangled nonwoven.

32. Process according to claim 27, wherein the sum of the amounts of wood pulp fibers and fibers from regenerated cellulose together make up at least 80% of the mass of the hydro-entangled nonwoven.

33. Process according to claim 27, wherein the aqueous suspension of step A has a solids content of at most 3.0%.

34. Process according to claim 27, wherein the running web used in steps B and C is inclined upwards with respect to the horizontal in the running direction of the fiber web by an angle of at least 3° and at most 40°.

35. Process according to claim 27, wherein a plurality of water jets is used to carry out the hydro-entangling in step E, wherein the water jets are arranged in at least one row orthogonal to the running direction of the fiber web.

36. Process according to claim 27, wherein at least two water jets are used to carry out the hydro-entangling in step E, wherein the at least two water jets are directed onto different sides of the fiber web.

37. Process according to claim 27, wherein a proportion of pulp fibers from hemp, flax, jute, ramie, abacá, sisal or cotton is a total of at most 1% of the mass of the hydro-entangled nonwoven.

38. Process according to claim 32, wherein the sum of the amounts of wood pulp fibers and fibers from regenerated cellulose together make up at least 95% of the mass of the hydro-entangled nonwoven.

39. Process according to claim 32, wherein the aqueous suspension of step A has a solids content of at most 0.05%.

* * * * *